US010151120B1

(12) United States Patent
Kaneshiro

(10) Patent No.: US 10,151,120 B1
(45) Date of Patent: Dec. 11, 2018

(54) SUN SHADE CANOPY SYSTEM

(71) Applicant: Leslie Yoshi Kaneshiro, Yuma, AZ (US)

(72) Inventor: Leslie Yoshi Kaneshiro, Yuma, AZ (US)

( * ) Notice: Subject to any disclaimer, the term of this patent is extended or adjusted under 35 U.S.C. 154(b) by 233 days.

(21) Appl. No.: 15/181,153

(22) Filed: Jun. 13, 2016

Related U.S. Application Data

(60) Provisional application No. 62/174,767, filed on Jun. 12, 2015.

(51) Int. Cl.

| | |
|---|---|
| ***E04H 6/02*** | (2006.01) |
| ***E04F 10/02*** | (2006.01) |
| ***E04B 1/32*** | (2006.01) |
| ***E04B 1/19*** | (2006.01) |
| ***E04H 12/22*** | (2006.01) |
| ***E02D 27/42*** | (2006.01) |

(52) U.S. Cl.
CPC ..... *E04H 6/025* (2013.01); *E02D 27/42* (2013.01); *E04B 1/19* (2013.01); *E04B 1/32* (2013.01); *E04F 10/02* (2013.01); *E04H 12/223* (2013.01); *E04B 2001/199* (2013.01); *E04B 2001/1993* (2013.01); *E04B 2001/1996* (2013.01)

(58) Field of Classification Search
CPC ..... E04H 15/04; A45B 2023/0031
See application file for complete search history.

(56) References Cited

U.S. PATENT DOCUMENTS

| | | | | |
|---|---|---|---|---|
| 2,896,651 | A * | 7/1959 | Hilligoss | E04B 7/163 126/299 R |
| 3,730,196 | A * | 5/1973 | Borskey | B60P 3/343 135/88.11 |
| 9,776,687 | B2 * | 10/2017 | Levin | B63B 17/02 |
| 2004/0226594 | A1 * | 11/2004 | Connelly | E04H 15/44 135/117 |
| 2008/0016786 | A1 * | 1/2008 | Bougioukos | E04H 6/025 52/4 |
| 2010/0051078 | A1 * | 3/2010 | Sy-Facunda | E04H 15/48 135/145 |

* cited by examiner

*Primary Examiner* — Sarah B McPartlin
(74) *Attorney, Agent, or Firm* — Invention To Patent Services; Alex Hobson

(57) ABSTRACT

A solar shade system includes a first and second canopy assembly that are configured to support a cantilevered beam out from a post. The cantilevered beam is utilized to support a canopy that extends substantially from the first and second canopy assemblies. A post coupler extends between the two posts and an extended end coupler extends between the two extended ends of the cantilevered beams. A canopy has four sides with sleeves configured on each side for receiving a support, such as a post coupler, an extended-end coupler and a canopy cantilever. The solar shade system is quick and easy to assemble.

19 Claims, 22 Drawing Sheets

SUN SHADE CANOPY SYSTEM

CROSS REFERENCE TO RELATED APPLICATIONS

The invention claims the benefit of priority to U.S. provisional patent application No. 62/174,767, filed on Jun. 12, 2015; the entirety of which is hereby incorporated by reference herein.

BACKGROUND OF THE INVENTION

Field of the Invention

The present invention relates to solar shade canopies.

Background

Canopies configured to protect people and vehicles from the sun are commonly used in very hot and sunny locations. Bus stops, bleachers, patios, play grounds, pools, rest stop areas, and the like may be ideal locations for a solar shade canopy. Vehicles parked in the sun can become excessively hot. It is desirable to protect vehicles from the sun, especially in very hot areas. The sun can damage vehicles, fade the paint and make the interior so hot that it is painful to enter and operate the vehicle. There exists a need for a solar shade system that is quick and easy to assemble and durable.

SUMMARY OF THE INVENTION

The invention is directed to a solar shade canopy system and method of assembly. Solar shade canopies may be employed in any location where people, animals, pets, or articles, such as vehicles may need to protected from the harsh rays of the sun. Solar shade canopies may be used to provide shade over bus stops, bleachers, patios, rest stop areas, pools, parking areas, and the like. In an exemplary embodiment, a solar shade canopy, as described herein, is configured to extend at least partially over a pool wherein the cantilevered beams and canopy extend over at least a portion of the pool. A solar shade canopy system may comprise a double cantilevered canopy assembly wherein the post is configured between two cantilevered beams that extend in opposing directions. In addition, a solar shade canopy system may be configured as a double canopy system wherein two canopies are supported by three canopy assemblies with a single canopy assembly configured between the two canopies.

An exemplary solar shade system comprises a first and a second canopy assembly that are each configured to support a cantilevered beam that extends out substantially horizontally from a post that is secured to the ground, or base support and extends up substantially vertically. The two canopy assemblies are offset from each other by width to define the shade area provided by a canopy. A canopy is configured between the two posts and extends out over the cantilevered beams. A first and a second post are anchored in the ground, or secured at their base to a fixed structure, and extend up substantially vertically from said ground to a top-end and have a length from the ground to the top-end. A post has a length axis that extends along the length of the post. A cantilevered beam is coupled to the post, at a desired height from the ground, by a post bracket that is attached to the post collar. A post collar may be a true collar having an aperture therethrough and extending completely around the post. A collar may however only partially surround the post, such as by extending around at least three sides of the post, or at least 270 degrees around the post, when the post is a pole having a circular outer cross-sectional shape. A post bracket and a post collar may be integral, or be rigidly attached to each other, such as by welding, for example. The cantilever beam extends substantially horizontally from the post bracket to an extended-end and has a length from the end of the cantilevered beam configured in the post bracket to the extended end.

A support is coupled to the post, above the cantilever beam, by a support bracket and extends out to a support end that is coupled with the extended end of the cantilevered beam by a support-end bracket. In an exemplary embodiment, the support is attached to the support bracket proximal to the top-end of the post. The support is coupled to the cantilever beam, proximal to the extended-end of the cantilevered beam, by the support-end bracket. The support extends at an angle from the support-end to the support bracket. This angle may be about 20 degrees or more, about 30 degrees or more, about 45 degrees or more and any range between and including the angles provided. A support may have a circular or polygonal outer cross-sectional shape. A support may be a rod or tube, or a beam having a square or rectangular shape. A support may in some embodiments be a cable, such as a metal cable that is flexible and retained between the support bracket and the support-end bracket in tension.

A post coupler extends and has a length between the post brackets of the first and the second canopy assemblies. A post coupler is attached to the post bracket of opposing posts and provides additional support by providing a connection between the two posts. An extended-end coupler extends, having a length, between the end brackets of the first and the second canopy assemblies. The post coupler and extended end couplers create a connection across the width between the two canopy assemblies. The post coupler and extended-end coupler may support the canopy, as described herein.

A canopy is configured to be retained around its perimeter by a plurality of supports and it is preferable that these supports be circular in outer cross-sectional shape. A canopy cantilever extends, having a length, from an end attached to the post bracket to the end bracket and extends essentially parallel with the cantilever beam. A canopy may comprise a canopy sleeve that is configured to slide over the canopy cantilevers for support. The canopy may also be configured with canopy sleeves configured for sliding over the post coupler and the extended-end coupler. In an exemplary embodiment, a canopy has four sides, each with a canopy sleeve and when assembled, the sleeve on each side is retained within one of the canopy cantilevers or the post coupler or the extended-end coupler. The canopy may comprises an connector between the sides that is arced or angled between the ends of the two adjacent side sections. For example, a canopy may have an arced connector portion, or cut-away portion, that facilitates assembly of the canopy and reduces stresses in the corners.

A canopy extends up to an apex that is substantially centered within the canopy, or has a substantially pyramid shape. The canopy is supported by a canopy support comprising canopy support extensions that extend from the corners of the canopy structure up to the apex. The canopy support comprises a first canopy support extension coupled to the post bracket of the first canopy assembly, a second canopy support extension coupled to the post bracket of the second canopy assembly, a third canopy support extension coupled to the end bracket of the first canopy assembly, and a fourth canopy support extension coupled to the end bracket of the second canopy assembly. A canopy support extension may be a pole that includes end connectors that can be moved, such as slid to and from the canopy support extension along the length, to enable orientation and attachment to the brackets. A extended end connector of a canopy support extension may extend into the canopy support extension, and may be a rod or tube that has a smaller outer diameter than an inner diameter of the canopy support extension. The canopy support extensions are preferably configured under the canopy, wherein they support the canopy into the pyramid shape. The canopy support extension may however be configured above the canopy and be attached to the canopy along the length from the bracket at the corner of the structure to the apex. Straps or sleeves may be configured to retain a canopy to canopy supports. When the canopy is above the canopy supports however, no attachment may be required to couple the canopy to the canopy support extensions.

The apex of the canopy, or the location of the apex bracket, may be any suitable offset height above the height of the cantilevered beam, such as about 25 cm or more, about 50 cm or more, about 75 cm or more about 100 cm or more, and any range between and including the offset heights provided. The rise angle of the canopy support extensions, or the angle from horizontal as measured from the attached end at the corner brackets, may be any suitable angle including about 10 degrees or more, about 20 degrees or more, about 40 degrees or more about 50 degrees or more and any range between and including the angles provided.

A canopy is a material that blocks at least a portion of the sunlight and may comprise a fabric that is permeable to water. A canopy may be a woven fabric having openings in the weave to allow water to permeate therethrough. A canopy may be made out of a synthetic material, such as polymeric material, or nature material, such as cotton, or any combination thereof. A canopy may comprise a coating to protect it from sun damage, such as UV degradation of the polymer or a coating to facilitate the run-off of water, such as a hydrophobic coating. A canopy material may allow wind to pass therethrough and may have a Frazier value of 50 or more, about 100 or more, or about 500 or more, or about 1000 or more, as measured by a Frazieometer. A canopy with a high air permeability will have less force exerted on it from wind and may be more durable over time. A Frazieometer measures the cubic feet of air that will pass through one square foot of material at a half inch pressure drop across the material. A preferred canopy has a high air permeability or high Frazier value and also blocks a high percentage of sunlight, or light, such as about 60% or more, about 75% or more or about 85% or more.

A post collar may be configured to slide along the length of the post and a post may comprise a plurality of attachment apertures configured along the length for receiving a fastener that extends through an aperture in the post collar. A post collar and post bracket may be a one-piece unit. A post bracket may be coupled to the post collar or to the cantilevered beam, or a combination of attachment locations.

A support bracket is typically configured proximal to the top-end of the post and may comprise a collar that extends around a substantial portion of the post or may be rigidly attached to the post, such as by welding. A support bracket may be cap that extends over the top-end of the post, having an interior volume for receiving the top-end of the post. A post may comprise a plurality of attachment apertures configured along the length for the attachment of the support bracket.

An exemplary end bracket is configured proximal to the extended-end of the cantilevered beam and may comprise a collar that extends around a substantial portion of the cantilevered beam or may be rigidly attached to the cantilevered beam, such as by welding. An end bracket may be cap that extends over the extended-end of the cantilevered beam, having an interior volume for receiving the extended end of the cantilevered beam. A cantilevered beam may comprise a plurality of attachment apertures configured along the length for the attachment of the end bracket.

A post and/or cantilevered beam may have any suitable shape but are preferably rectangular in shape to provide a greater amount of deflection support for their weight. A post and/or cantilevered beam may be configured in an I-beam shape as well, thereby optimizing the amount of bending or deflection support for the weight.

The canopy supports, as well as the canopy cantilevers, the post coupler and the extended-end coupler preferably have a circular or at least rounded outer shape as these components are in direct contact with the canopy and a circular or rounded outer surface will prevent wear of the canopy from abrasion.

A solar shade canopy system may be any suitable size and may have a width between the canopy assemblies, or posts of about 2 m or more, about 3 m or more about 4 m or more, about 5 m or more, about 7 m or more and any range between and including the widths provided. A solar shade canopy system may be configured to fit one, two or three cars between the posts, for example. A solar shade canopy system may have a cantilevered beam at any suitable height from the ground such as about 1.5 m or more, about 2 m or more about 3 m or more about 4 m or more and any range between and including the heights provided.

A solar shade canopy system may be a double canopy system wherein a center canopy assembly is configured between a first side and second side canopy assembly, as described herein. A center canopy assembly may comprise a double post bracket having attachments on either side for a post coupler, canopy support extension and a canopy cantilever. A double post bracket may be a one-piece unit and this may provide increase stability and make assembly more convenient.

Likewise, a double canopy system may comprise a double end bracket that is configured between a first side and second side canopy assembly, as described herein. Likewise, a double end bracket may have attachments on either side for an extended-end coupler, canopy support extension and a canopy cantilever.

It is to be understood that a double canopy assembly may be configured in series, wherein three or four canopies are configured in-line and each canopy assembly between the two end canopy assemblies comprises a double post bracket and a double end bracket.

An exemplary method of assembly of an exemplary solar shade canopy system is provided herein. The solar shade canopy system of the present invention enables quick and easy assembly. A first and a second post are secured to the ground in a substantially vertical orientation. A support bracket and/or post collar and/or post bracket may be attached to the post before it is secured to the ground. In addition, a support may be attached to the support bracket before the post is erected and secured to the ground. A post may be secured directly into the ground, such as into a hole in the ground or more preferably to a plate or other structure that is rigidly fixed to the ground or fixed object. The post collar and/or post bracket may be positioned along the length of the post and secured at a desired height for the cantilevered beam. A cantilevered beam is secured to the post bracket and the support is extended out to the end bracket and attached to secure the cantilevered beam in a substantially horizontal orientation. A post coupler is extended between the two posts and attached to the two post brackets. An extended-end coupler is extended between the two extended ends of the cantilevered beams and secured to the two end brackets. Canopy cantilevers are configured along each of the cantilevered beams and secured between the respective post brackets and the end brackets. A canopy having four sides and a canopy sleeve along each side is configured around the canopy cantilevers, the post coupler and extended-end coupler prior to their attachment to the brackets. The plurality of canopy support extensions are attached to their respective brackets, as described herein. A canopy apex connector is coupled between opposing extended ends of the canopy support extensions. An apex bracket is attached to at least one of the canopy apex connectors. The apex bracket, canopy and extended ends of the canopy support extensions are elevated to a desired apex height. The canopy apex connectors slide or move relative to the canopy support extensions as the canopy is elevated. When the canopy is at a desired height, the canopy apex connector are attached to the canopy support extensions, thereby locking and securing the canopy at a desired height and in a substantially pyramid shape.

The solar shade canopy systems as described herein may be configured to meet structural requirements for these types of structures including, load, rain and wind bearing requirements. The unique structure of the double cantilevered canopy assemblies reduces the size and weight requirements of the post, as the load is somewhat balances between the front and back cantilevered beams and associated supports. The double cantilevered canopy assembly enables lower weight beams as the forces are somewhat balanced by the opposing forces of the beams and the supports. In addition, a canopy may have a relatively high air permeability, such as greater than 100 frazier, therein reducing the wind load on the structure.

The summary of the invention is provided as a general introduction to some of the embodiments of the invention, and is not intended to be limiting.

Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
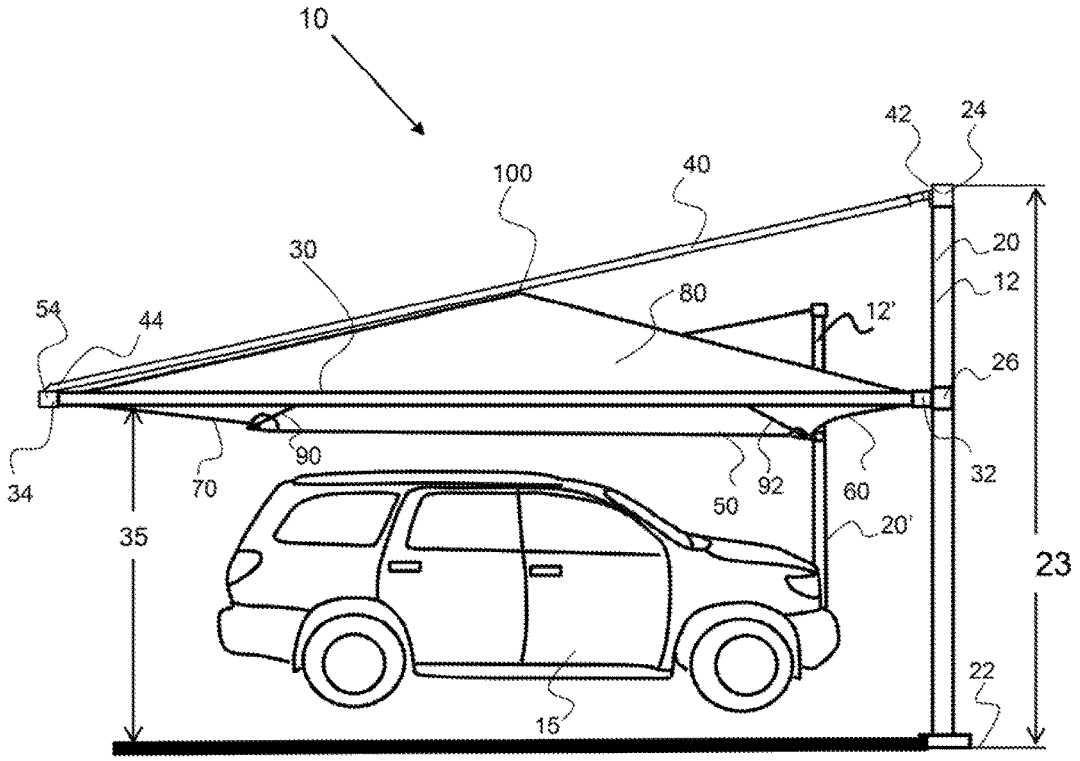
FIG. 1 shows a side view of an exemplary solar shade canopy system having a vehicle parked thereunder.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary solar shade canopy system 10 has a vehicle 15 parked thereunder. The solar shade canopy system comprises a first and a second canopy assembly 12, and 12', respectively. The canopy assembly comprises a post 20 that extends from the ground 22 up, substantially vertically, to a top-end 24. The post has a length 23 and a length axis along the length. A cantilever beam 30 is coupled to each of the posts by a post bracket 32. The post bracket 32 is attached to the post collar 26. The post collar substantially surrounds the post and preferably surrounds the post having an aperture for configuring the post within the post collar. The cantilever beams extend out, substantially horizontally, or substantially perpendicular to the post's vertical axis at a height 35. In addition, the cantilever beams extend out substantially parallel to each other. Each canopy assembly comprises a support 40 that extends from the support bracket 42 to an support end. The support end is coupled to the cantilever beam 30 by an end-bracket. The support is under tension and provides additional support of the extended end of the cantilevered beam. A post coupler 60 extends between the two posts 20, 20' and is attached to each post bracket. An extended-end coupler extends between the two extended ends of the cantilevered beams and is attached to each end bracket. A canopy cantilever 50 extends out from the post and is attached to the post bracket 32 one end and the end bracket on the other end. The canopy cantilevers are configured inside of the cantilevered beams and extend substantially parallel with the cantilevered beams. The canopy 80 extends between two canopy cantilevers and between the post coupler and the extended-end coupler. The canopy extends over a canopy support 90 comprising a plurality of canopy support extensions. As shown, a second canopy support extension extends from a second post 20' up towards the apex 100 of the canopy.

Figure 2:
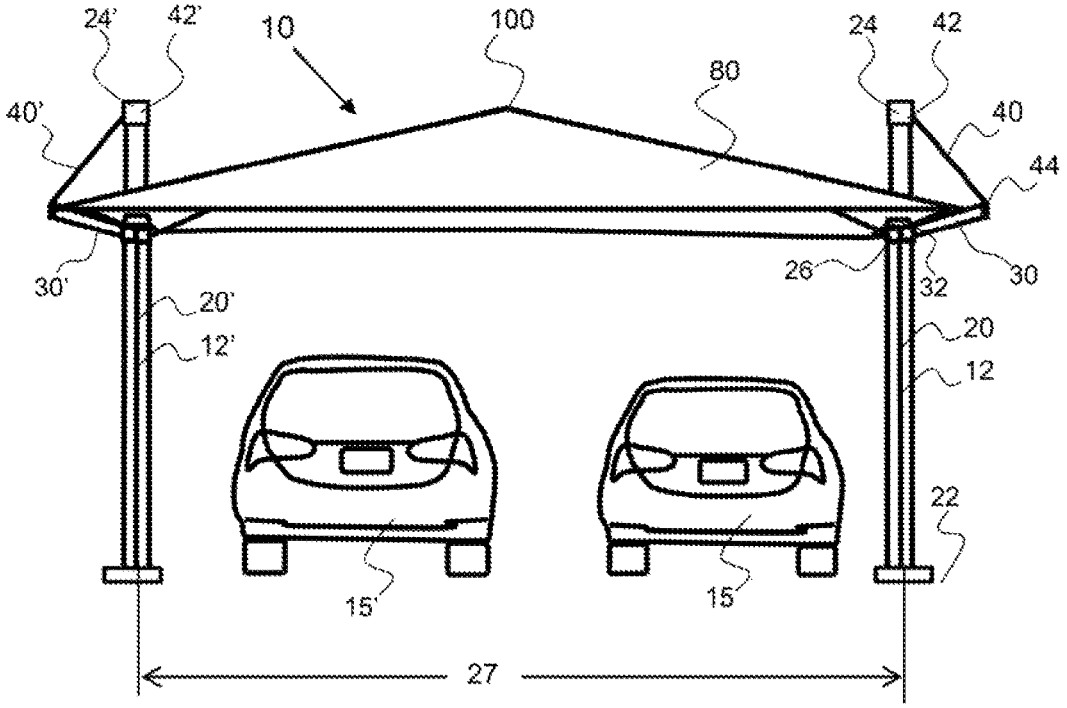
FIG. 2 shows a back view of exemplary solar shade canopy system with two vehicles parked thereunder.

As shown in FIG. 2, an exemplary solar shade canopy system 10 has two vehicles 15, 15' parked thereunder. The two posts 20, 20' are separated by a width 27.

Figure 3:
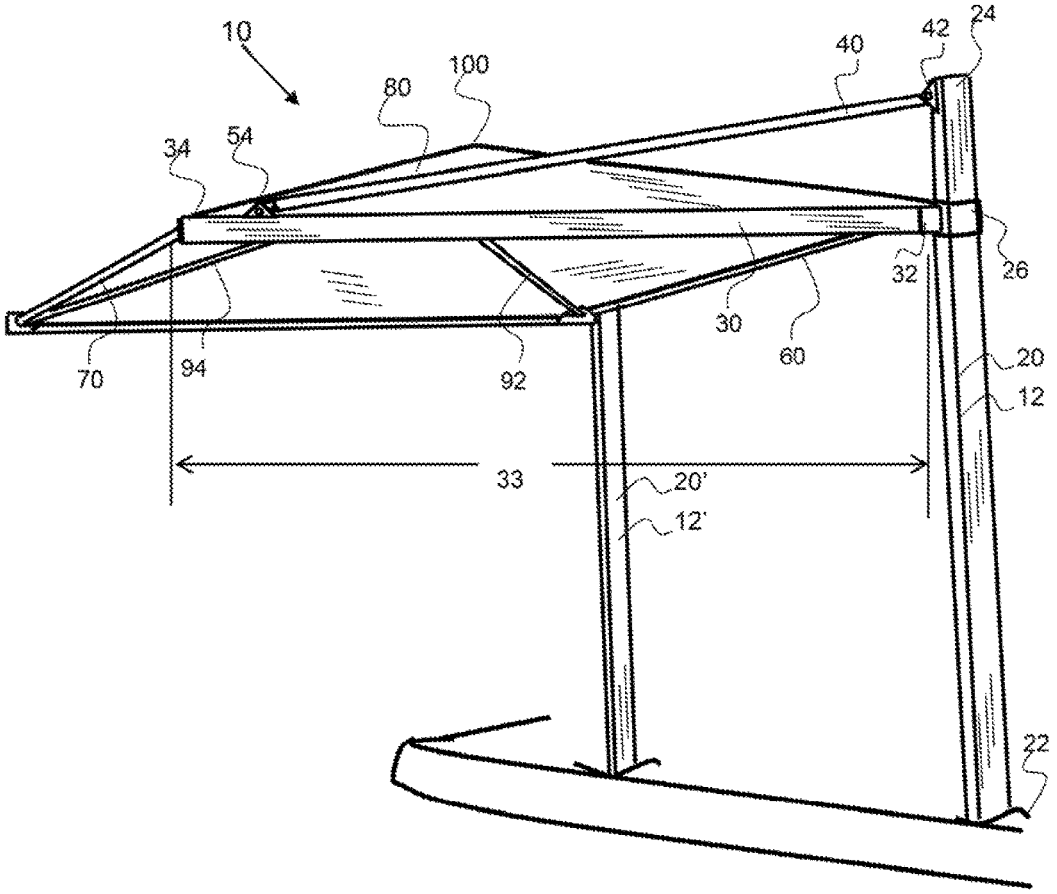
FIG. 3 shows a back-side perspective view of an exemplary solar shade canopy system.

As shown in FIG. 3, an exemplary solar shade canopy system 10 comprises a first and second canopy assemblies 12, 12'. The second and fourth canopy supports 92, 94, respectively, are shown extending up to the apex 100 of the canopy 80. The post coupler 60 and extended-end couplers 70 are shown coupling the two canopy assemblies together. The length 33 of the cantilevered beam 30 is shown. A cantilevered beam 30 extends out from the post bracket 32 that is attached to the post collar. The support 40 extends from the support bracket 42 down to an end bracket 54 that is configured proximal to the extended end 34 of the cantilevered beam 30.

Figure 4:
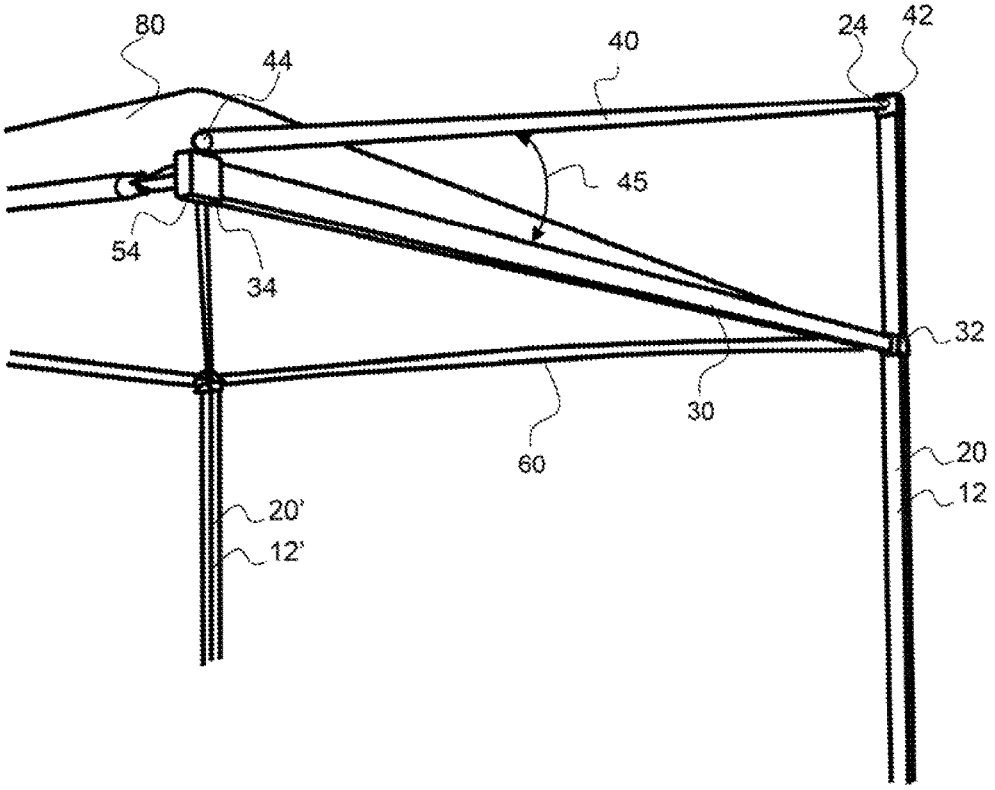
FIG. 4 shows a back-side perspective view of a portion of an exemplary solar shade canopy system.

As shown in FIG. 4, an exemplary solar shade canopy system 10 comprises an end bracket 54 that is attached around the extended end of the cantilevered beam 30. The support 40 is attached to the end bracket 54 and extends up at an angle 45 to the support bracket 42 attached proximal to the top-end 24 of the post 20.

Figure 5:
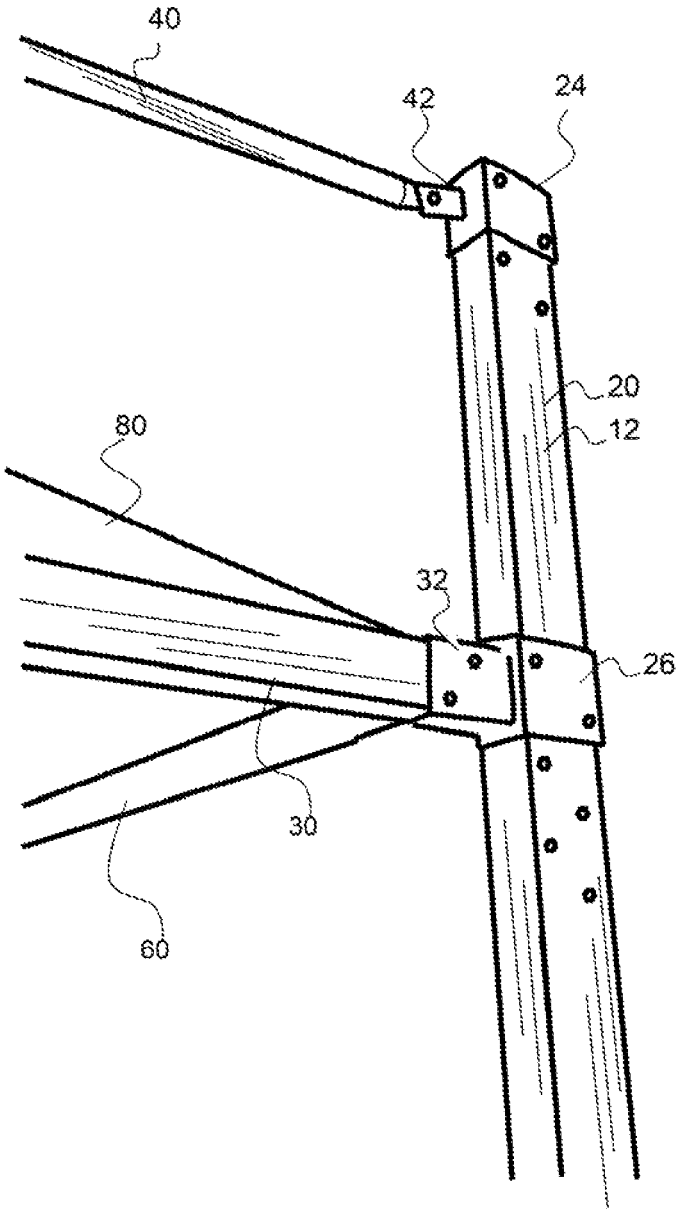
FIG. 5 shows a side perspective view of a an exemplary post having a post collar and support bracket attached thereto.

As shown in FIG. 5, an exemplary post 20 has a post collar 26 and support bracket 42 attached thereto. A cantilevered beam 30 extends out from the post bracket 32 that is attached to the post collar. The support 40 extends from the support bracket 42. The post collar is a true collar that has an aperture for extending the post therethrough. The support bracket 42 is attached to a cap that extends over the post 20.

Figure 6:
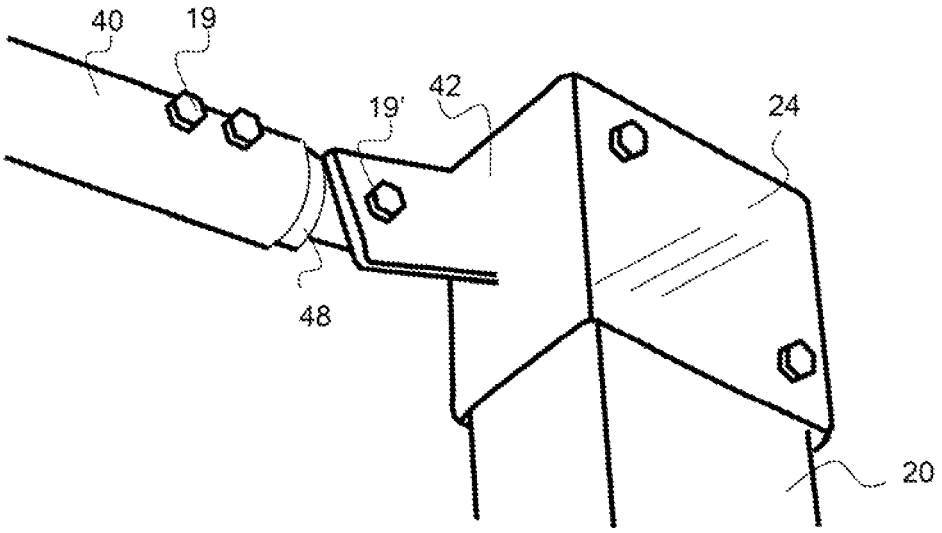
FIG. 6 shows a perspective view of an exemplary support bracket attached to a post and a support extended therefrom.

As shown in FIG. 6, an exemplary support bracket 42 is attached to a post 20 and a support 30 extends therefrom. A support connector 48 extend to the support bracket 42 and couples the support 40 to the support bracket. The support connector is configured to slide or move relative to the support to enable easy alignment and attachment. Fasteners 19 are shown attaching the support connector to the support. Fastener 19' is shown attaching the support connector to the support bracket. The support connector in this embodiment is circular in cross-section and slides within the support pipe.

Figure 7:
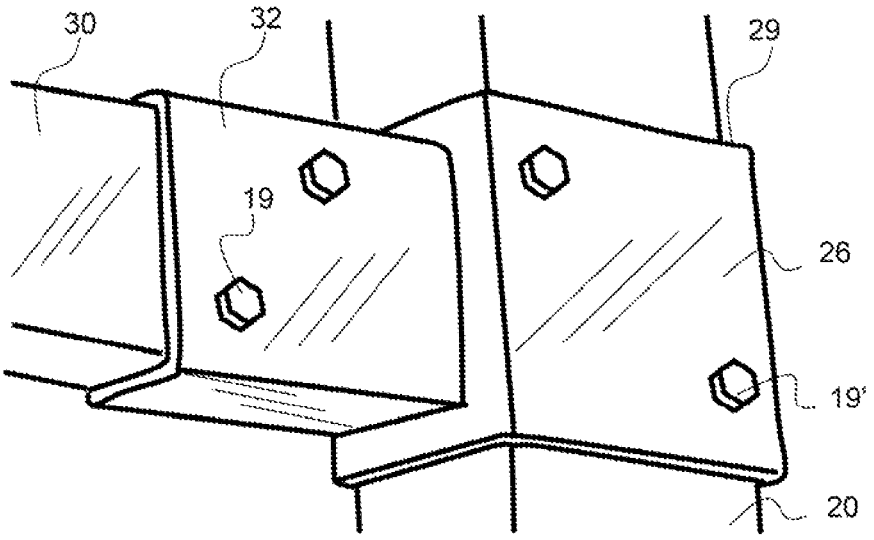
FIG. 7 shows a perspective view of an exemplary post bracket and a cantilevered beam extended therefrom.

As shown in FIG. 7, a cantilevered beam 30 is coupled to a post bracket 32. The post bracket 32 is attached to the post collar 26, wherein they are a one-piece unit. The post bracket may be welded or otherwise affixed to the post collar. The post 20 extends through an aperture 29 in the post collar.

Figure 8:
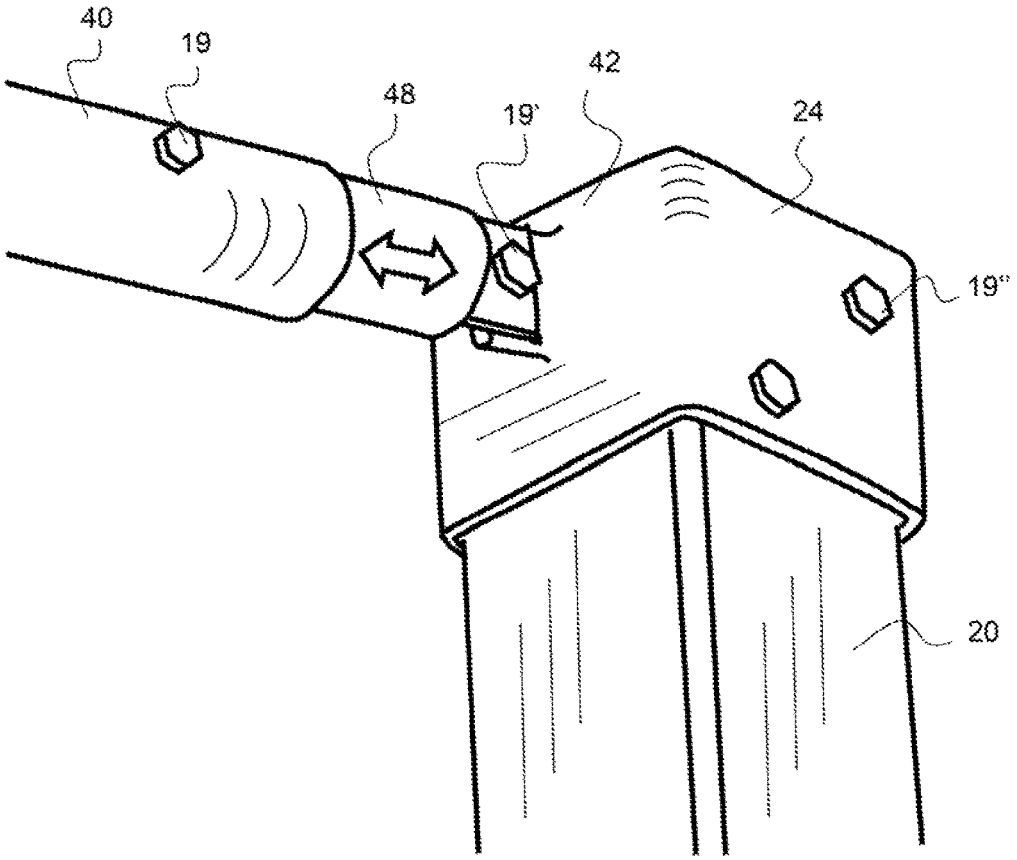
FIG. 8 shows a perspective view of an exemplary support bracket attached to a post and a support having a support connector attached to the support bracket.

As shown in FIG. 8, an exemplary support bracket 42 is attached to a post 20 and a support 40 extends therefrom. A support connector 48 extend to the support bracket 42 and couples the support 40 to the support bracket. The support connector is configured to slide or move relative to the support, as indicated by the bold arrow, to enable easy alignment and attachment. Fasteners 19 are shown attaching the support connector to the support. Fastener 19' is shown attaching the support connector to the support bracket. The support connector in this embodiment is circular in cross-section and slides within the support pipe.

Figure 9:
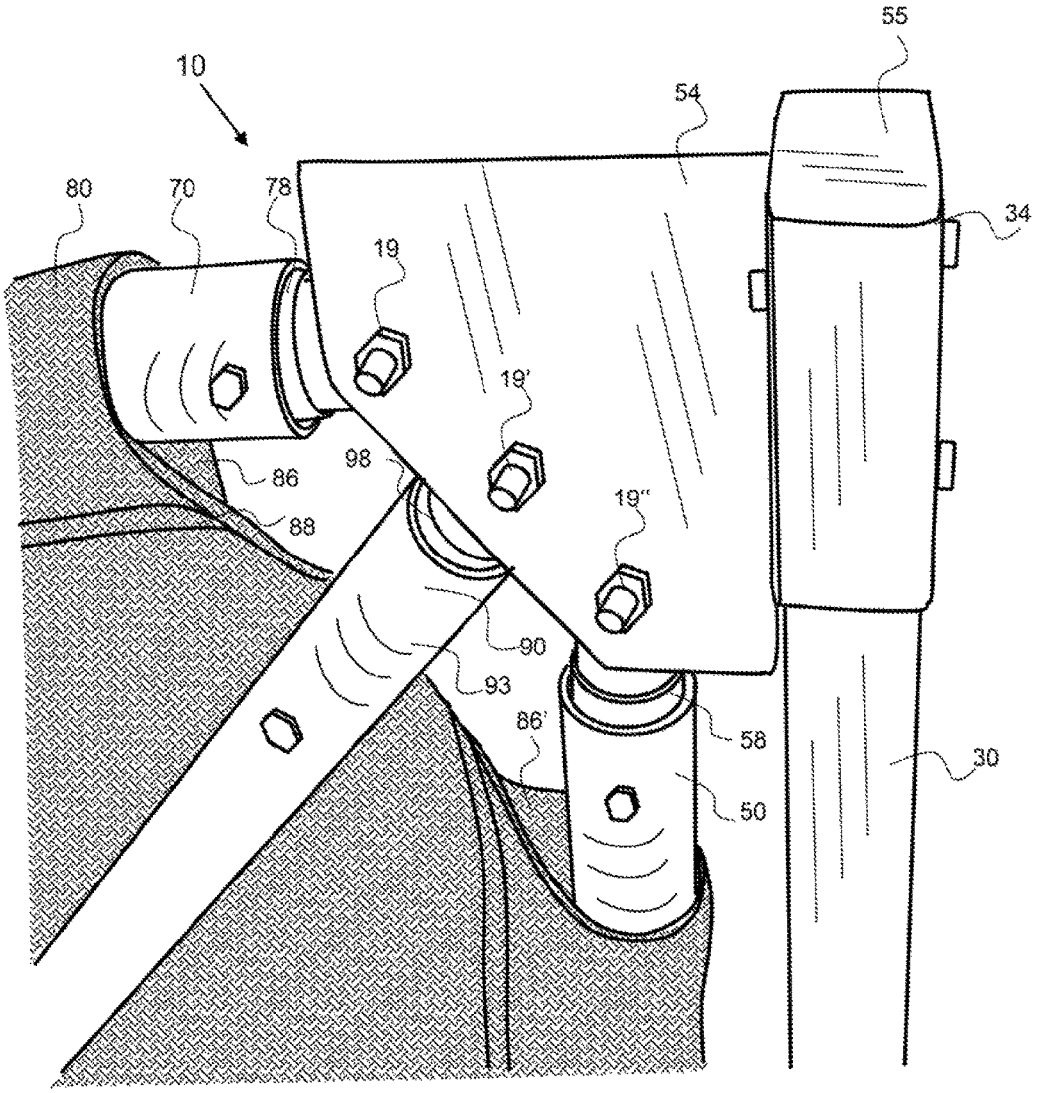
FIG. 9 shows a bottom-side perspective view of an exemplary extended-end bracket attached to the extended end of the cantilever beam and a canopy cantilever, an extended-end coupler and a canopy support extension attached to the extended-end bracket.
Figure 10:
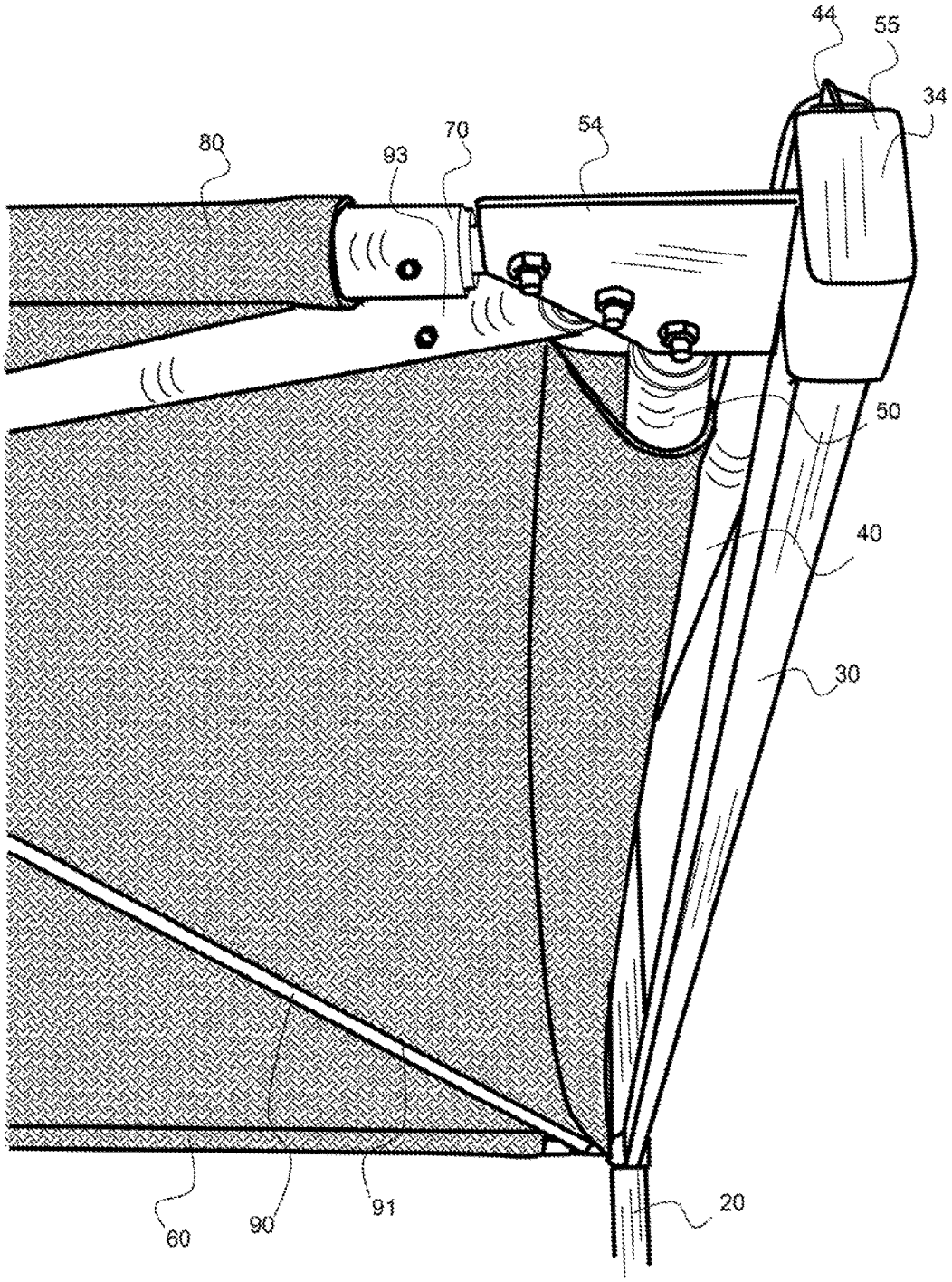
FIG. 10 shows a perspective view of an exemplary extended-end bracket attached and a canopy having a canopy sleeve configured around a canopy cantilever that is a rod having a circular cross-section.

Referring now to FIGS. 9 and 10, an exemplary end bracket 54 is attached to the extended end 34 of the cantilever beam 30. The extended end is configured within an extended end-cover 55. The extended-end cover encapsulates or caps the extended end of the cantilever beam. The end bracket extends horizontally from the cantilever beam and comprises an attachment plate for the attachment of the canopy cantilever 50, the third canopy support extension 93, and the extended-end coupler 70. A canopy cantilever connector 58 couples the canopy cantilever with the end bracket 54 and is configured to move relative to the end of the canopy cantilever. Likewise the extended-end coupler 70 comprises a extended-end coupler connector 78 that couples the extended-end coupler to the end bracket and is configured to slide within the extended-end coupler for ease of orientation and attachment. The canopy support extension 93 also comprises a canopy support connector that moves relative to the end of the canopy support extension. As shown in FIG. 9, the canopy 80 comprises canopy sleeves 86, 86' that are configured around the extended-end coupler 70 and the canopy cantilever 50. The canopy sleeves are formed from by folding the canopy material over along a side and attaching the end to the canopy material to form an attachment 88, such as a sewn or welded seam. As shown in FIG. 10, the canopy comprises a canopy sleeve that is configured around the post coupler 60 and the extended-end coupler 70.

Figure 11:
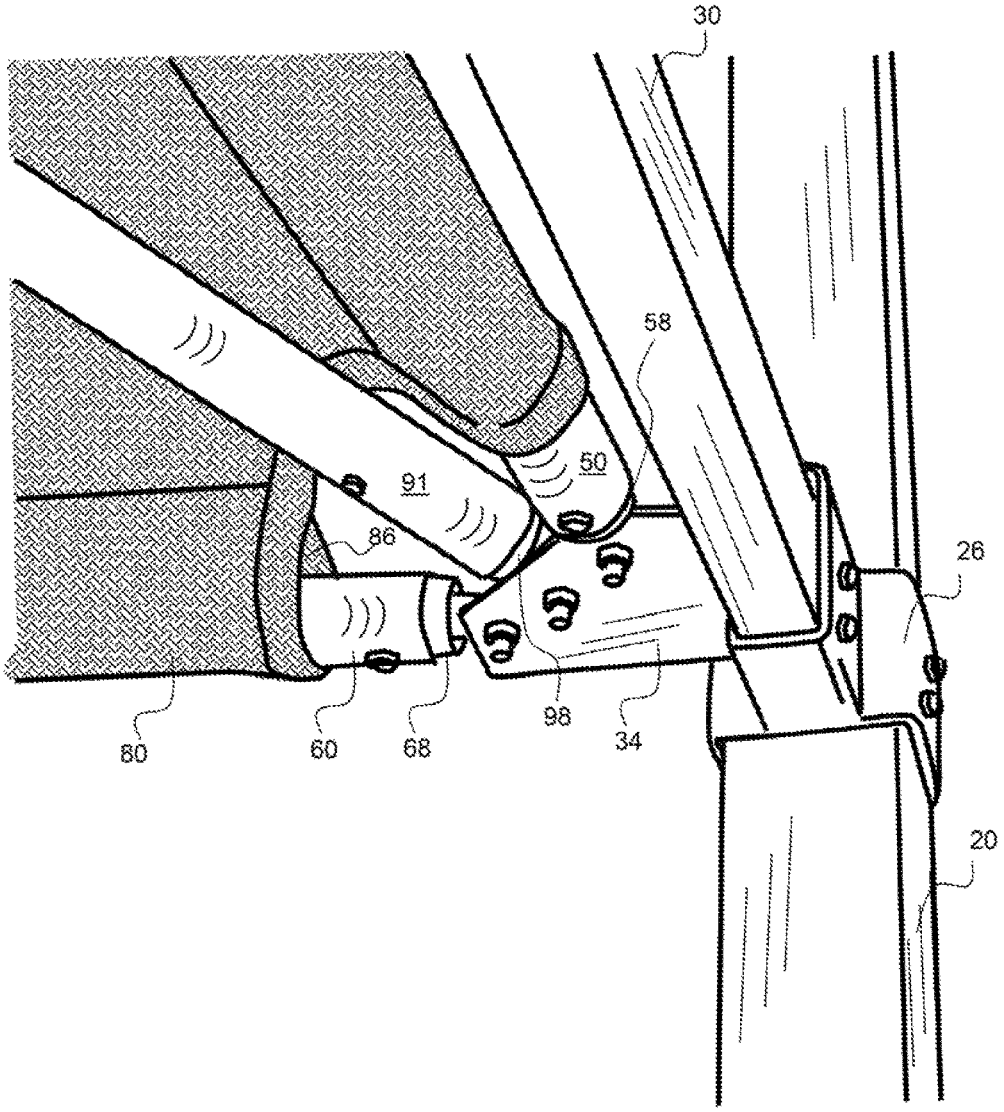
FIG. 11 shows a perspective view of an exemplary post bracket attached to a post collar.

As shown in FIG. 11, an exemplary post bracket 34 is attached to a post 20 by a post collar 26 that extends around the post. The post bracket 34 extends out substantially horizontally from the post and has the canopy cantilever 50, the post coupler 60, and the first canopy support extension 91 attached thereto. As described herein, the canopy cantilever comprises a canopy cantilever connector that is configured to move independently from the canopy cantilever to enable quick alignment and orientation before attachment. The first canopy support extension comprises a canopy support extension 98 that is configured to move for orientation. The post coupler 60 comprises a post coupler connector 68 that is configured to move for orientation and attachment.

Figure 12:
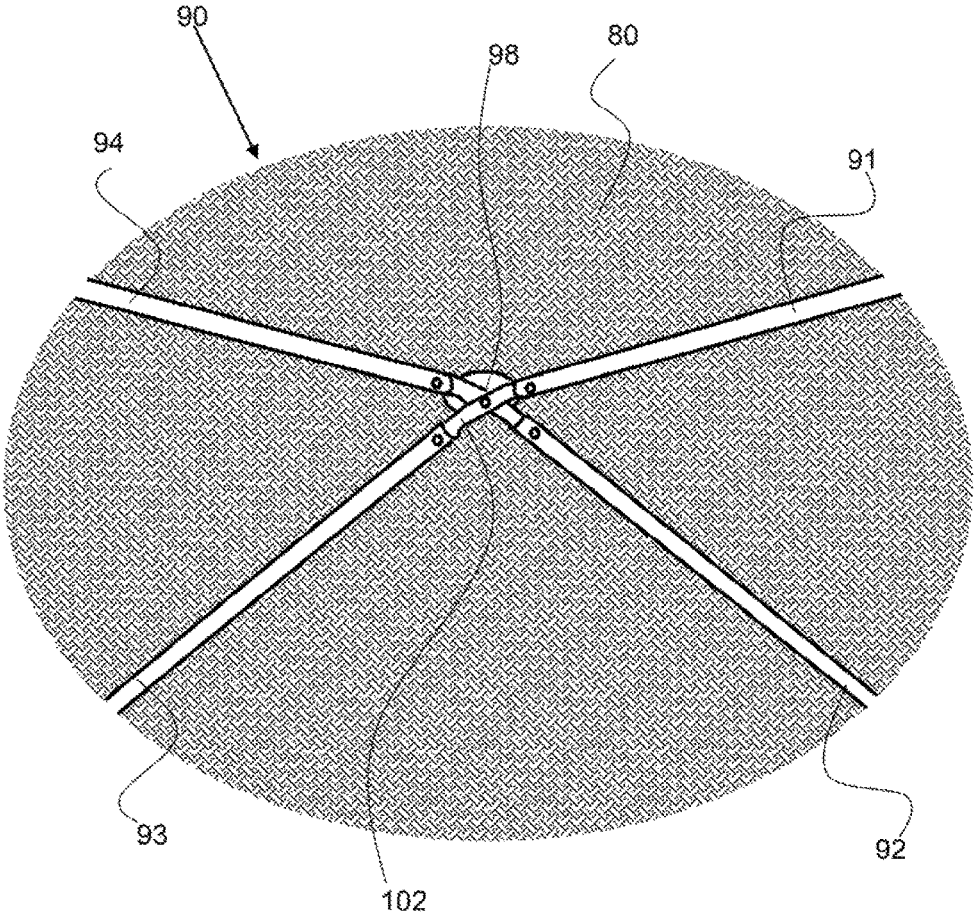
FIG. 12 shows a bottom-up view of a canopy supported four canopy support that are attached to an apex bracket by canopy support connectors.
Figure 13:
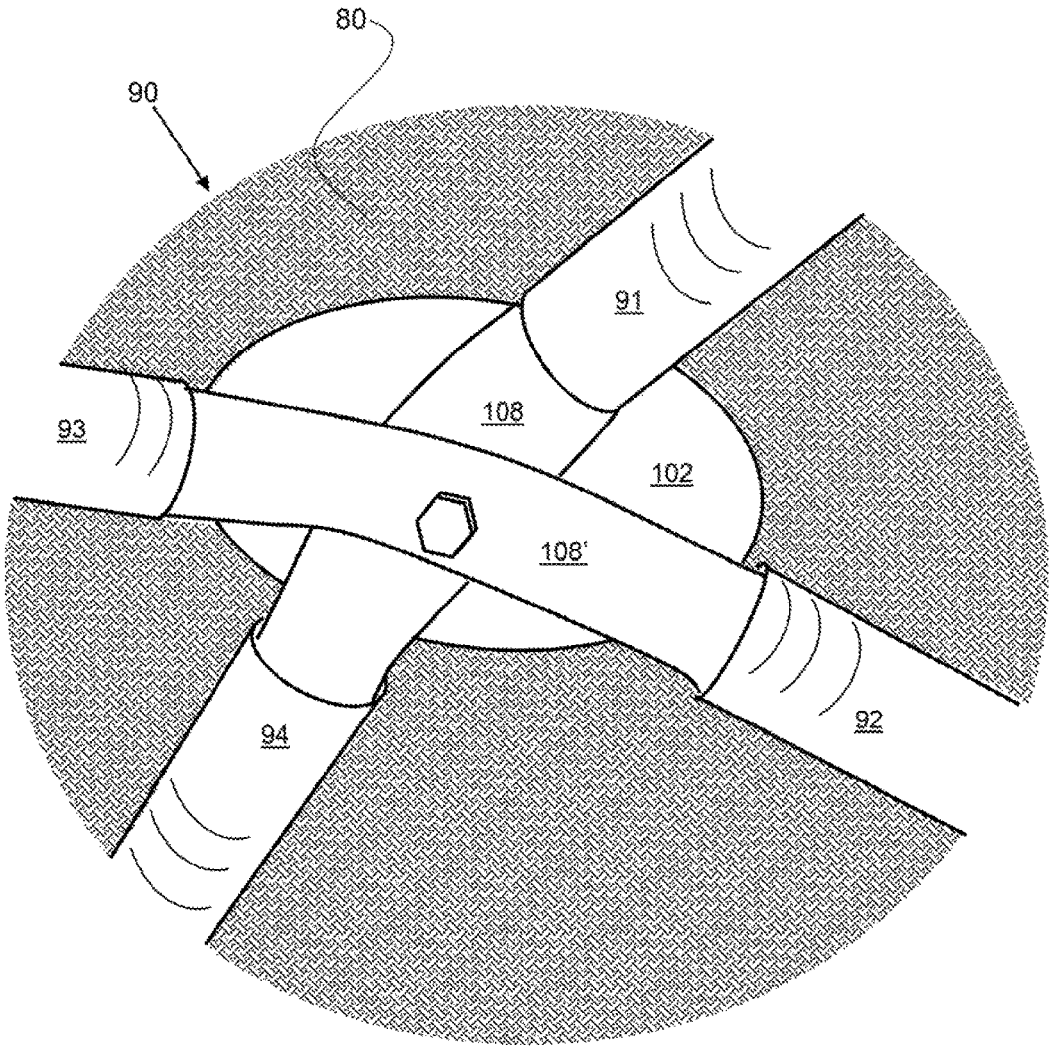
FIG. 13 shows a bottom and enlarged view of the apex of the solar shade canopy having canopy support connectors extending from the canopy supports and coupled to the apex bracket.

Referring now to FIGS. 12 and 13, a canopy support 90 comprises a first 91, second 92, third 93 and fourth 94 canopy support extensions that extend substantially a corner of the canopy to the apex. Opposing canopy support extensions are coupled together by a canopy apex connector 108, that extends from one end of a canopy support extension to the end of an opposing canopy support extension. As shown in FIG. 13, the canopy apex connectors, 108, 108' are configured to slide or move relative to the canopy support extensions to enable movement and engagement while the canopy is being configured in an elevated orientation above the height of the cantilevered beams. The canopy apex connectors are attached to a apex bracket 102 that may be dome shaped to provide support for the canopy 80 while reducing wear on the canopy.

Figure 14:
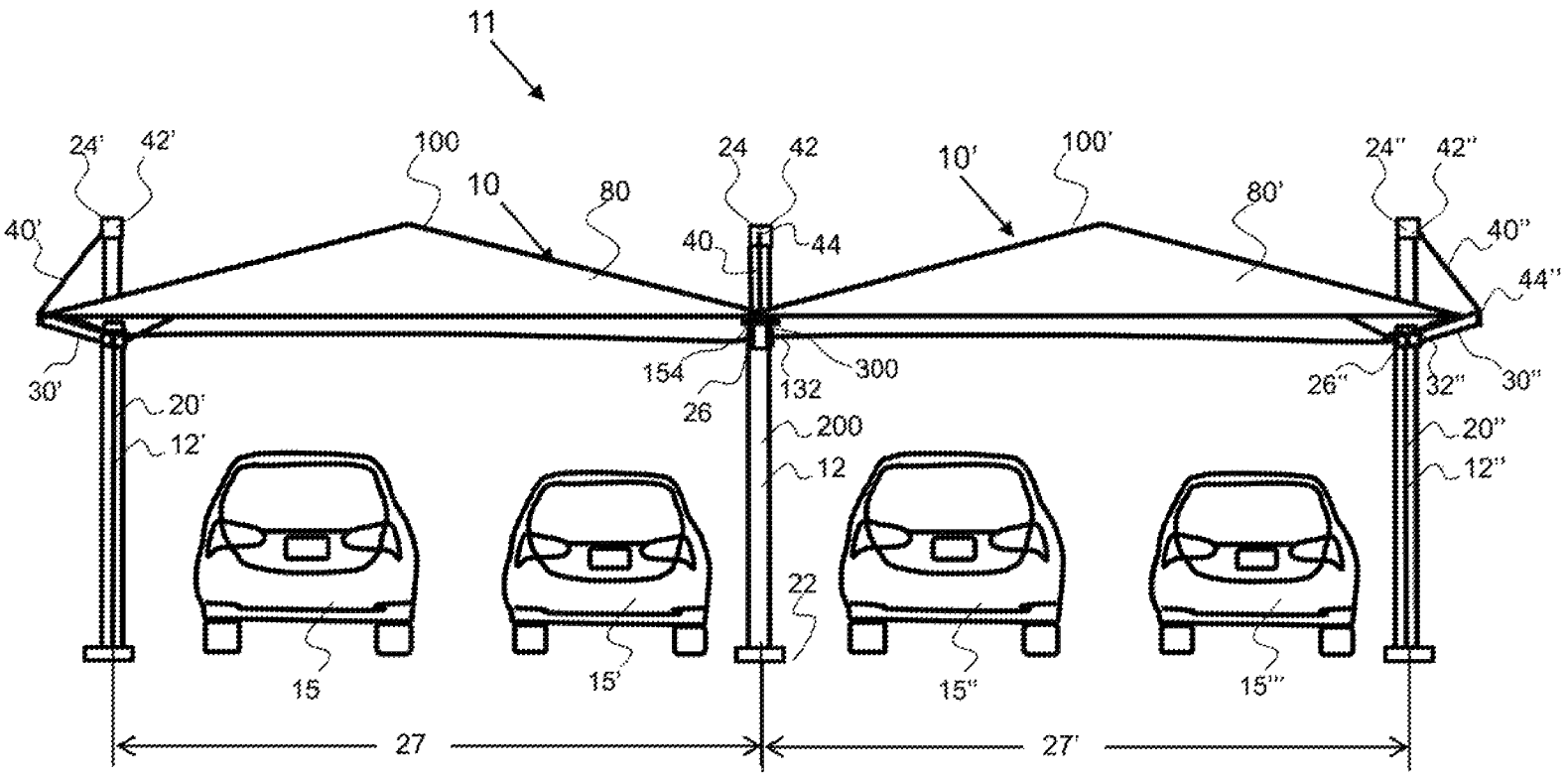
FIG. 14 shows a back view of a double solar shade system comprising three post assemblies and two canopies.

As shown in FIG. 14, an exemplary double solar shade canopy system 11 comprising three canopy assemblies 12, 12', 12" and two canopies 80, 80'. A center canopy assembly supports one side of the two canopies and the outside canopy assemblies support the outer sides of the two canopies. In this design, a reduced amount of material is required for multiple canopy systems. The outer canopy assemblies 12' and 12" may be configured like a canopy assembly for a single solar shade canopy system. The central canopy assembly 12 however, may comprise a double post bracket 132 and a double end bracket 154. The double post bracket may be attached to the center post 200.

Figure 15:
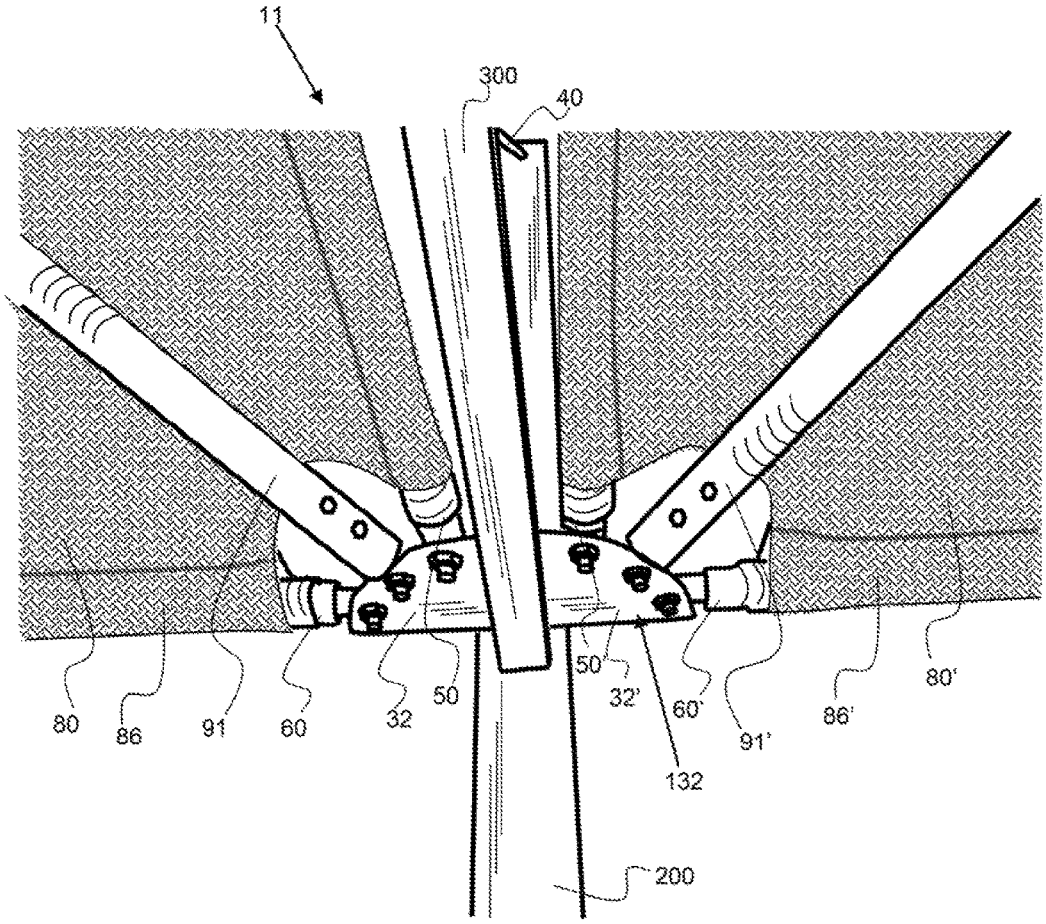
FIG. 15 shows a bottom-up view of an exemplary double post bracket configured on a post.

As shown in FIG. 15 an exemplary double post bracket 132 is configured on the center post 200. The double post bracket comprises a first bracket 32 and a second bracket 32'. The first bracket is supporting a first canopy 80 and the second bracket 32', of the double post bracket 132, is supporting the second canopy 80'. A double post bracket may be an integral double post bracket that is a single piece of material. For example, an integral double post bracket may be a single plate that extends across the center cantilever beam 30. Additional rigidity may be realized by utilizing an integral double post bracket.

Figure 16:
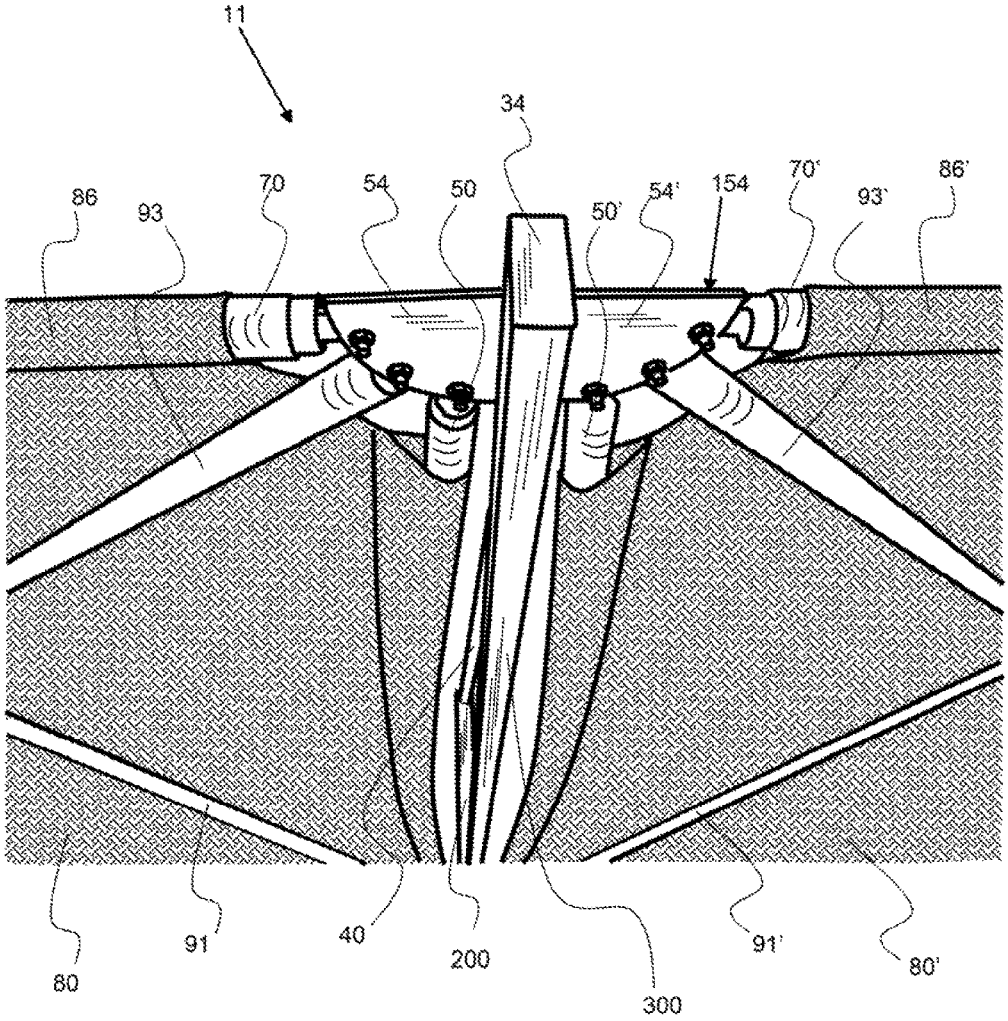
FIG. 16 shows a bottom-up view of an exemplary double end bracket.

As shown in FIG. 16, an exemplary double end bracket 154 comprises a first end bracket 54 and a second end bracket 54'. Again, a double end bracket may be an integral double end bracket and be made out of single piece of material.

Figure 19A:
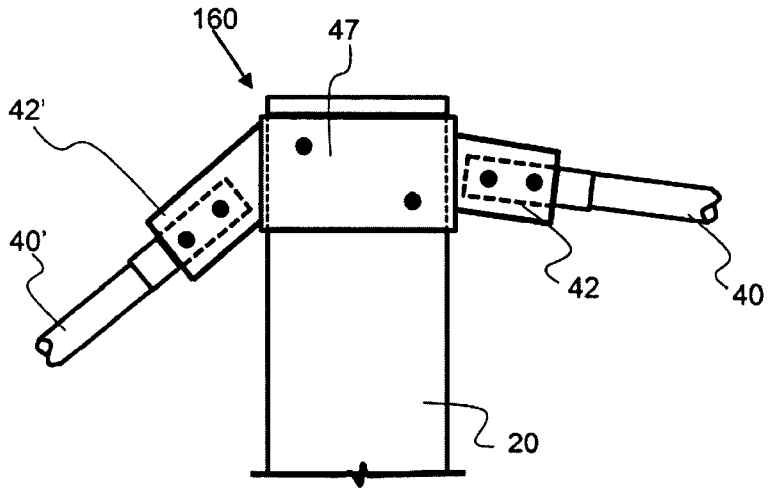
FIG. 19A shows a side view of the top-end of a post of an exemplary double cantilever canopy assembly having a first and a second support extending in opposing directions.

FIG. 19A shows a side view of the top-end of a post of an exemplary double cantilever canopy assembly having a first and a second support extending in opposing directions.

Figure 17:
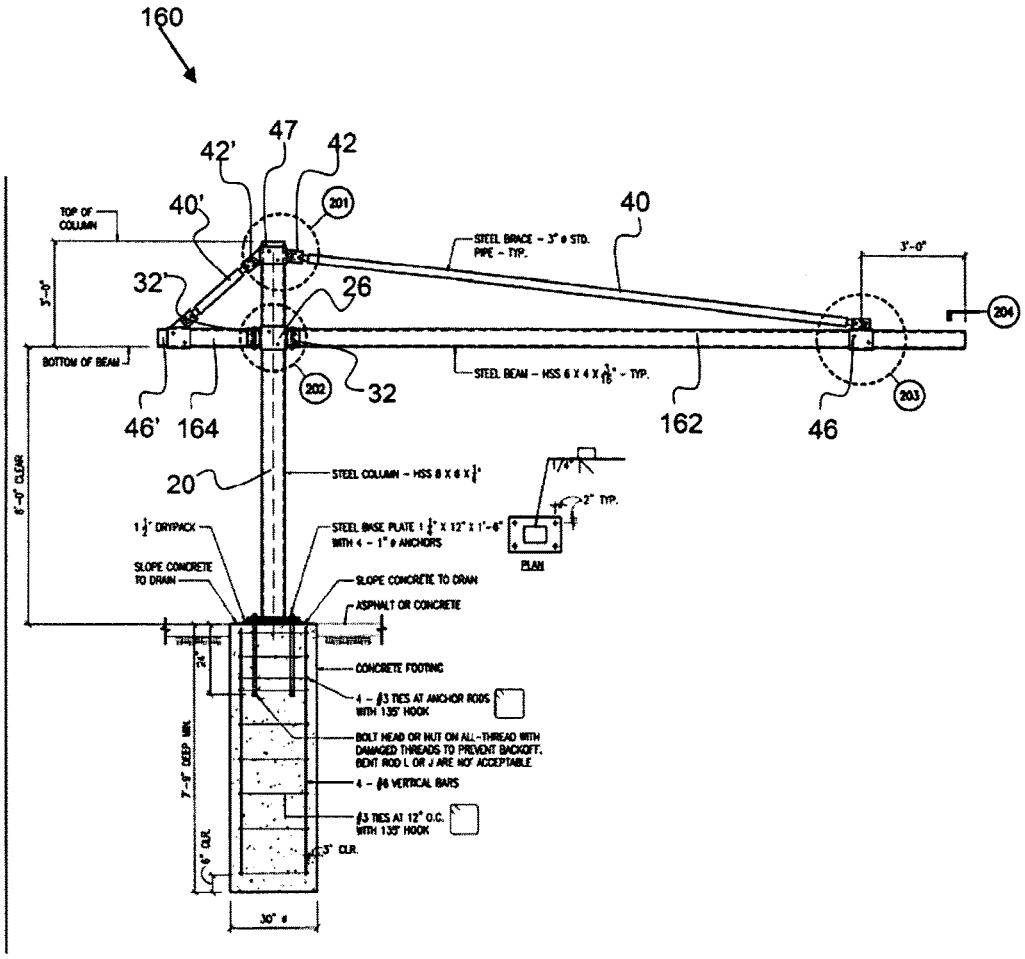
FIG. 17 shows a side view of an exemplary double cantilever canopy assembly.

As shown in FIG. 17, an exemplary double cantilever canopy assembly 160 comprises a first cantilevered beam 162 that extends from the post in a first direction and a second cantilevered beam 164 that extends from the post in a second and substantially opposite direction to said first direction. The first and second cantilevered posts are attached to the post 20 by post brackets 32, 32' respectively, and in one embodiment, the this is a one-piece unit and may comprise a post collar 26 that extends around the post having an aperture therein for receiving the post. The two cantilevered beams are supported by a first and second support 40, 40' respectively. The supports extend from the support brackets 42, 42' which are attached to a support collar 47. The support collar extends around the post 20. The supports create opposing forces on the top-end of the post and therefore reduce the size and/or thickness requirement for the post. Each of the supports are coupled to the cantilevered beams by a support-end bracket. The post is offset along the length of the canopy, which extends substantially from the extended end of each cantilevered beam.

Figure 18:
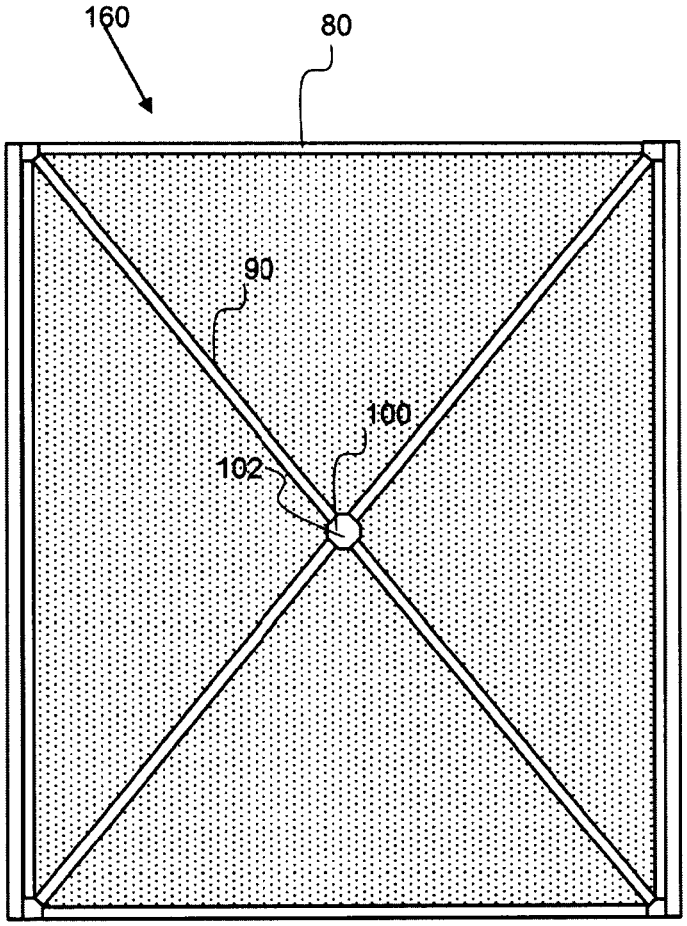
FIG. 18 shows a top-down view of an exemplary solar shade canopy assembly.

As shown in FIG. 18, an exemplary solar shade canopy 80 extends out to four corners and has a generally rectangular shape, as seen from above. The canopy extends up to an apex 100 where canopy support extensions 90 are coupled with an apex bracket 102

Figure 19B:
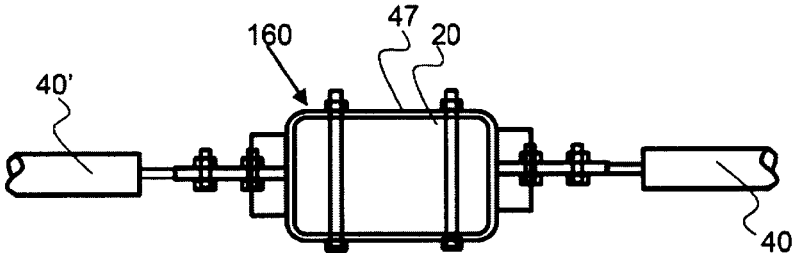
FIG. 19B shows a bottom-up view along line 19B in FIG. 19A.

As shown in FIGS. 19A and 19B, an exemplary double cantilever canopy assembly has a first and a second support 40, 40' respectively extending in opposing directions. The supports extend from support brackets 42 and extend in opposing direction from the post 20. A support collar 47 extends around the outer perimeter of the post.

Figure 20A:
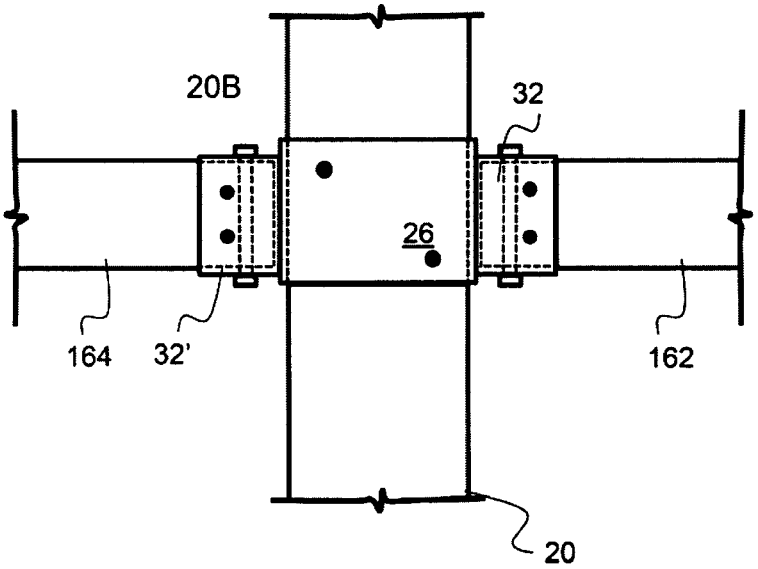
FIG. 20A shows a side view of the post collars of an exemplary double cantilever canopy assembly having a first and a second cantilevered beams extending in opposing directions.
Figure 20B:
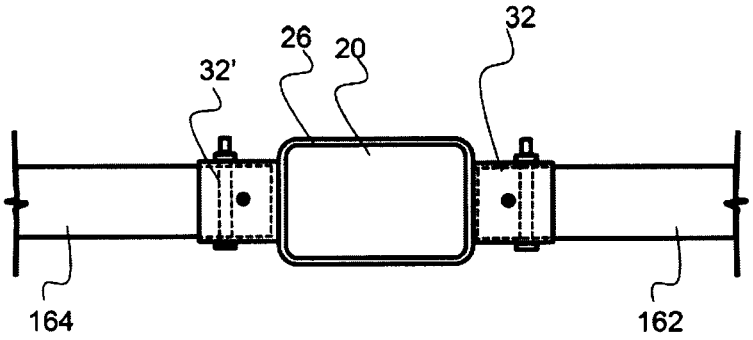
FIG. 20B shows a top-down view along line 20B in FIG. 20A.

As shown in FIGS. 20 A and 20B, cantilevered beams 162 and 164 extend out from the post in opposing directions and are attached to post brackets 32, 32'. The post brackets are attached to a post collar 26 that extends around the post 20.

Figure 21A:
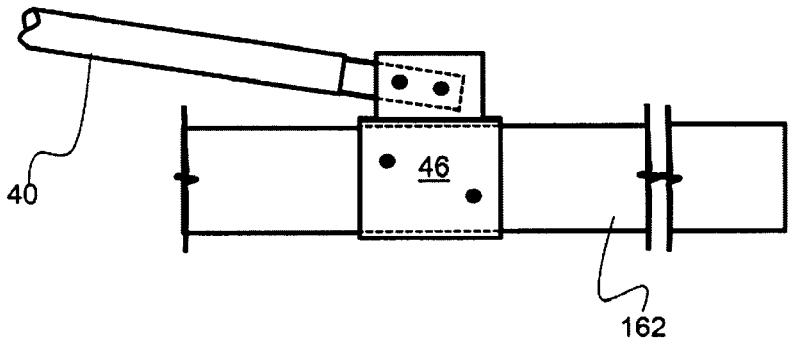
FIG. 21A shows a side view of the exemplary support end bracket shown in FIG. 19.
Figure 21B:
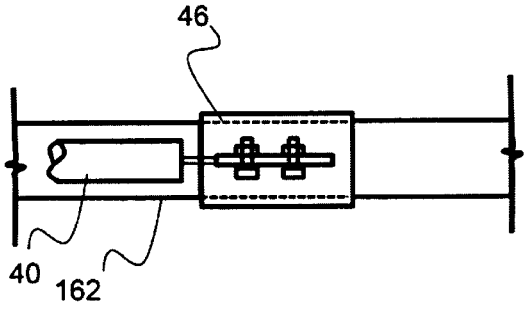
FIG. 21B shows a top-down view along line 21B in FIG. 21A.

As shown in FIGS. 21A and 21B, an exemplary support-end bracket 46 couples the support-end of the support 40 with cantilevered beam 162. The support end bracket extends around the cantilevered beam and is a support-end collar.

Figure 22A:
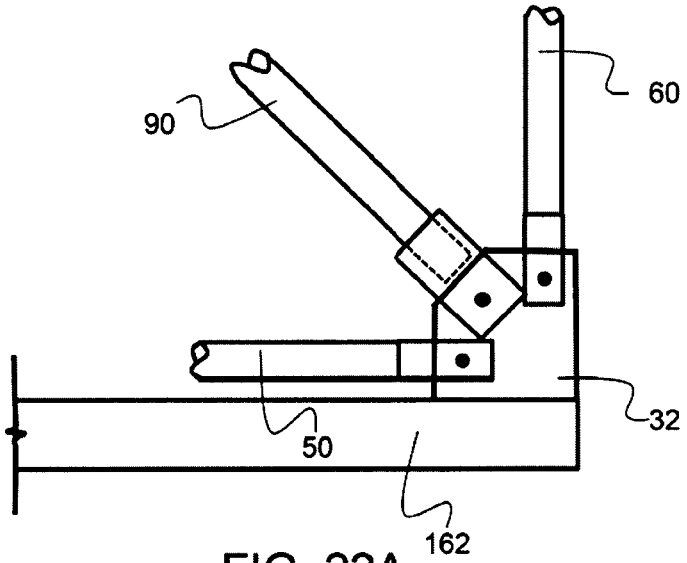
FIG. 22A shows a top-down view of a portion of a corner of a canopy assembly having a cantilevered beam, extending from a post, a canopy cantilever, a post coupler, and a canopy support extension.
Figure 22B:
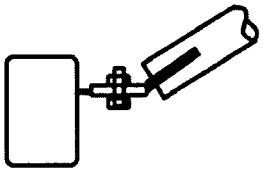
FIGS. 22B and 22C shows cross-sectional views along lines X and Y in FIG. 22A respectively.
Figure 22C:
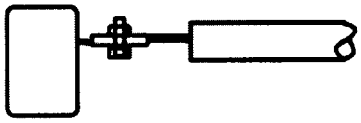

Referring now to FIGS. 22A-22C, the post bracket 32 is configured to couple the post coupler 60, the canopy cantilever 50 and the canopy support 90 to the post 20.

Figure 23:
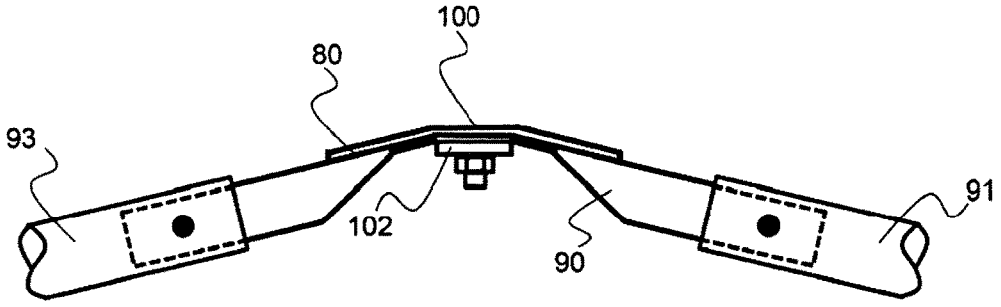
FIG. 23 shows an exemplary apex bracket.

As shown in FIG. 23, the extended ends of the canopy support extensions 91, 93 are attached to the apex bracket 102. The canopy 80 extends over the canopy support 90.

Definitions

A canopy as used herein is a material that blocks at least a portion of the sun but may be porous and allow a reduced amount of light to pass therethrough.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A solar shade canopy system comprising:

a. a first and a second canopy assembly each comprising:

i. a post that is configured to be anchored in the ground and extends up substantially vertically from said ground to a top-end and has a length from said ground to said top-end and a length axis;

ii. a cantilevered beam that is coupled to said post at a height from the ground by a post bracket that is attached a post collar;

wherein the post collar substantially surrounds the post;

wherein the cantilever beam extends substantially horizontally from the post bracket to an extended-end and has a length from the post bracket to the extended end;

iii. a support that is coupled with the post, above the cantilever beam, by a support bracket and extends out to a support-end;

wherein the support-end of the support is coupled to the cantilever beam, proximal to the extended-end, by an end bracket;

wherein the support extends at an angle from the support-end to the support bracket;

iv. a canopy cantilever that extends, having a length, from the post bracket to the end bracket and extends essentially parallel with the cantilever beam;

wherein the first and second canopy assemblies are offset by a width and wherein the cantilever beams of the first and second canopy assemblies extend out from the first and second posts essentially parallel to each other to their respective extended ends;

b. a post coupler that extends, having a length, between the post brackets of the first and the second canopy assemblies;

c. an extended-end coupler that extends, having a length, between the end brackets of the first and the second canopy assemblies;

d. a canopy having four sides and extending between the canopy cantilevers of the first and the second canopy assemblies and between the post coupler and the extended-end coupler;

wherein the canopy comprises canopy sleeves on each of said four sides and wherein the canopy sleeves extend around the canopy cantilevers, the post coupler and the extended-end coupler;

e. a canopy support comprising;

i. a first canopy support extension coupled to the post bracket of the first canopy assembly;

ii. a second canopy support extension coupled to the post bracket of the second canopy assembly, iii. a third canopy support extension coupled to the end bracket of the first canopy assembly;

iv. a fourth canopy support extension coupled to the end bracket of the second canopy assembly;

wherein the first, second, third and fourth canopy support extensions are coupled to an apex bracket;

wherein the apex bracket is elevated to an apex height that is above the height of the cantilever beams;

wherein the apex is substantially centrally located between the four sides of the canopy.

2. The solar shade canopy system of claim 1, wherein the canopy is permeable to water.

3. The solar shade canopy system of claim 1, wherein the solar shade canopy system comprises vertical supports and wherein the first and second collars are configured to slide along the vertical supports.

4. The solar shade canopy system of claim 1, wherein post collars surround the posts.

5. The solar shade canopy system of claim 1, wherein post collars and the post bracket are a one-piece unit.

6. The solar shade canopy system of claim 1, wherein the support bracket is configured at the top-end of the post.

7. The solar shade canopy system of claim 1, wherein a portion of the support bracket is configured around the top-end of the post.

8. The solar shade canopy system of claim 1, wherein the end bracket is configured around the extended end of the cantilever beam.

9. The solar shade canopy system of claim 1, wherein the post has a rectangular cross-sectional shape along substantially the entire length of the post.

10. The solar shade canopy system of claim 1, wherein the canopy cantilever has a circular cross-sectional shape along substantially the entire length of the cantilever beam.

11. The solar shade canopy system of claim 1, wherein the post coupler has a circular cross-sectional shape along substantially the entire length of the post coupler.

12. The solar shade canopy system of claim 1, wherein the extended-end coupler has a circular cross-sectional shape along substantially the entire length of the extended-end coupler.

13. The solar shade canopy system of claim 1, wherein the canopy cantilevers of the first and second canopy assemblies, the post coupler, and the extended-end coupler have a circular cross-section along substantially their entire length.

14. The solar shade canopy system of claim 1, wherein the canopy cantilevers of the first and second canopy assemblies, the post coupler, and the extended-end coupler have a curved rounded outer profile along substantially their entire length.

15. The solar shade canopy system of claim 1, wherein the canopy is permeable to water.

16. The solar shade canopy system of claim 1, wherein the cantilever beams have a height and wherein the apex bracket is elevated at least 30 cm above the height of the cantilever beams.

17. The solar shade canopy system of claim 1, wherein the first, second, third and fourth canopy support extensions are configured under the canopy.

18. The solar shade canopy system of claim 1, further comprising a first and second support extending from a location proximal to the top-end of the post to the location proximal to the extended ends of the first and second cantilevered beams respectively.

19. A double solar shade canopy system comprising:

a. a center canopy assembly and a first side canopy assembly and a second side canopy assembly, wherein the first side and second side canopy assemblies are configured on opposing sides of the center canopy assembly, each of said canopy assemblies comprising:

i. a post that is configured to be anchored in the ground and extends up substantially vertically from said ground to a top-end and has a length from said ground to said top-end and a length axis;

ii. a cantilevered beam that is coupled to said post at a height from the ground by a post bracket that is attached a post collar;

wherein the post collar substantially surrounds the post;

wherein the cantilever beam extends substantially horizontally from the post bracket to an extended-end and has a length from the post bracket to the extended end;

iii. a support that is coupled with the post, above the cantilever beam, by a support bracket and extends out to a support-end;

wherein the support-end of the support is coupled to the cantilever beam, proximal to the extended-end, by an end bracket;

wherein the support extends at an angle from the support-end to the support bracket;

a canopy cantilever that extends, having a length, from the post bracket to the end bracket and extends essentially parallel with the cantilever beam;

wherein the first side and second side canopy assemblies are offset by a first and second width, respectively and wherein the cantilever beams of the center, the first side and the second side canopy assemblies extend out, from their respective posts, essentially parallel to each other to their respective extended ends;

b. a first side post coupler that extends, having a length, between the post brackets of the center canopy assembly and the first side canopy assembly;

c. a second side post coupler that extends, having a length, between the post brackets of the center canopy assembly and the second side canopy assembly d. a first side extended-end coupler that extends, having a length, between the end brackets of the center canopy assembly and the first side canopy assembly;

e. a second side extended-end coupler that extends, having a length, between the end brackets of the center canopy assembly and the second side canopy assembly;

f. a first canopy having four sides and extending between the canopy cantilevers of the center and first side canopy assemblies and between the first side post coupler and the first side extended-end coupler;

g. a second canopy having four sides and extending between the canopy cantilevers of the center and second side canopy assemblies and between the second side post coupler and the second side extended-end coupler;

wherein the first and second canopies comprises canopy sleeves on each of said four sides and wherein the canopy sleeves extend around the respective canopy cantilevers, the post couplers and the extended-end couplers;

h. a first canopy support comprising;

i. a first canopy support extension coupled to the center post bracket of the center canopy assembly;

ii. a second canopy support extension coupled to the post bracket of the first side canopy assembly, iii. a third canopy support extension coupled to the end bracket of the center canopy assembly;

iv. a fourth canopy support extension coupled to the end bracket of the first side canopy assembly;

wherein each of the first, second, third and fourth canopy support extensions of the first canopy support are coupled to an apex bracket that is centrally located between the four sides of the first canopy to support the first canopy:

i. a second canopy support comprising;

i. a first canopy support extension coupled to the center post bracket of the center canopy assembly;

ii. a second canopy support extension coupled to the post bracket of the second side canopy assembly, iii. a third canopy support extension coupled to the end bracket of the center canopy assembly;

iv. a fourth canopy support extension coupled to the end bracket of the second side canopy assembly;

wherein each of the first, second, third and fourth canopy support extensions of the second canopy support are coupled to an apex bracket that is centrally located between the four sides of the second canopy to support the second canopy.

* * * * *